US005381853A

United States Patent [19]

Koivisto et al.

[11] Patent Number: 5,381,853

[45] Date of Patent: Jan. 17, 1995

[54] APPARATUS FOR INTENSIFYING COOLING IN THE CASTING OF METAL OBJECTS

[75] Inventors: Markku H. Koivisto; Seppo I. Pietilä, both of Pori, Finland

[73] Assignee: Outokumpu Castform Oy, Espoo, Finland

[21] Appl. No.: 264,173

[22] Filed: Jun. 21, 1994

Related U.S. Application Data

[63] Continuation of Ser. No. 972,111, Oct. 30, 1992, abandoned.

[30] Foreign Application Priority Data

Nov. 14, 1991 [FI] Finland ..... 915374

[51] Int. Cl.[6] ..... B22D 11/124

[52] U.S. Cl. ..... 164/443; 164/485

[58] Field of Search ..... 164/440, 490, 484, 443, 164/485, 418, 459

[56] References Cited

U.S. PATENT DOCUMENTS

| | | | |
|---|---|---|---|
| 2,553,921 | 5/1951 | Jordan | 164/421 |
| 3,746,077 | 7/1973 | Lohikoski et al. . | |
| 4,211,270 | 7/1980 | Shinopulos et al. | 164/484 |

FOREIGN PATENT DOCUMENTS

| | | | |
|---|---|---|---|
| 0481380 | 4/1992 | European Pat. Off. . | |
| 2113870 | 10/1971 | Germany . | |
| 58-38639 | 3/1983 | Japan . | |
| 2-224849 | 9/1990 | Japan | 164/440 |

*Primary Examiner*—Kuang Y. Lin

*Attorney, Agent, or Firm*—Smith-Hill and Bedell

[57] ABSTRACT

The invention relates to an apparatus for intensifying cooling in the casting of metal objects, particularly in essentially vertical continuous upward casting. In order to intensify the cooling, the part (5) of the cooler (3) that is located nearest to the casting vessel is provided with a squeeze ring (6).

12 Claims, 2 Drawing Sheets

APPARATUS FOR INTENSIFYING COOLING IN THE CASTING OF METAL OBJECTS

This is a continuation of application No. 07/972,111 filed Oct. 30, 1992 and now abandoned.

The present invention relates to an apparatus for intensifying cooling in the casting of metal objects, particularly in essentially vertical continuous upward casting. In order to intensify the cooling, the part of the cooler that is nearest to the casting vessel is provided with a squeeze ring.

In continuous vertical upward casting of a metal object, known for example from the FI patent 46,693, the cooling of the metal object is normally carried out by using a cooler 3 as shown in FIG. 1, where the cooling agent is conducted to the bottom part of the cooler through the top, via the inlet located in the vicinity of the outer wall of the cooler. In FIG. 1, the molten metal is conducted to a nozzle 1; in the nozzle, at the height 2, there is formed a solidification front, where the molten metal turns solid. In the cooler 3, the cooling agent is conducted, by means of the intermediate pipe 4, first downwards, through the inlet, to the bottom part of the cooler, and further back up, to the top part of the cooler, to be discharged therefrom. The cooler is surrounded by a cover 7 of refractory material. It is apparent that the heat content discharged through the nozzle 1 is at its highest essentially at the solidification front 2, because metal, in the course of solidification, changes state and thus emits heat according to its temperature during the change of state.

While using the state-of-the-art cooler of FIG. 1 for instance in the casting of wire, where the casting is carried out at essentially high velocities, the increase in the temperature of the cast wire is observed as a function of time. While casting for instance copper wire at the rate of 6 m/min, the surface temperature of the wire may, after cooling, be over 500° C. Such an increase in the wire temperature generally causes the wire to break, which essentially weakens the operational efficiency of the apparatus. Among the reasons for the weakening of the cooling capacity and consequently for the increase in the wire temperature, let us point out for instance the high melting temperature capacity, which makes the temperature in the water surface of the cooler rise, so that an insulating vapor bubble is created in the cooling surface of the cooler. A further result is a thermal expansion at the bottom end of the cooler, which again creates a gap in the threading between the nozzle and the cooler.

The object of the present invention is to eliminate drawbacks of the prior art and to achieve a new, improved apparatus, which is more secure in operation, so that the cooling in continuous casting is made efficient with essentially high casting velocities, too. A particularly advantageous area for applying the invention is continuous upward casting.

According to the invention, a squeeze ring is installed at the bottom end of the cooler. The compression stress caused by the ring prevents the gap between the nozzle and the cooler from expanding, when the bottom end of the cooler—or in the case of horizontal casting, for instance, the outermost end of the cooler—tends to expand while the cooler is heated. By means of the squeeze ring, the situation can also be reversed, so that the normal gap in between the nozzle and the cooler is even reduced, because the squeeze ring directs the thermal expansion of the cooler towards the nozzle.

According to the invention, it is now possible to intensify cooling and thus prevent the breaking of the cast wire or tube while casting.

The invention is further illustrated by means of the appended drawings, where

Figure 1:
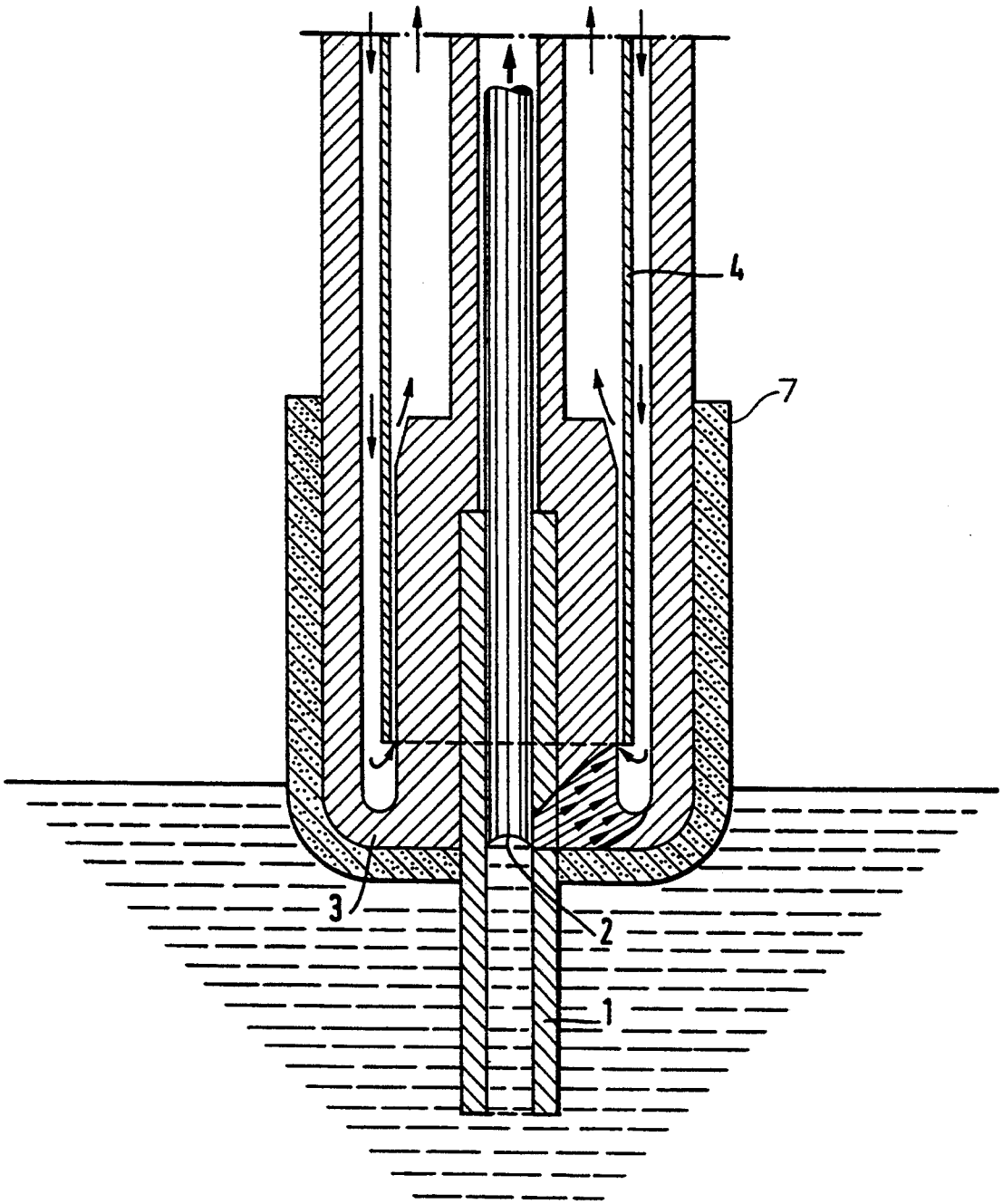
Fig. 1 PRIOR ART
FIG. 1 represents a state-of-the-art embodiment.

FIG. 1 was already explained in the description of the prior art.

Figure 2:
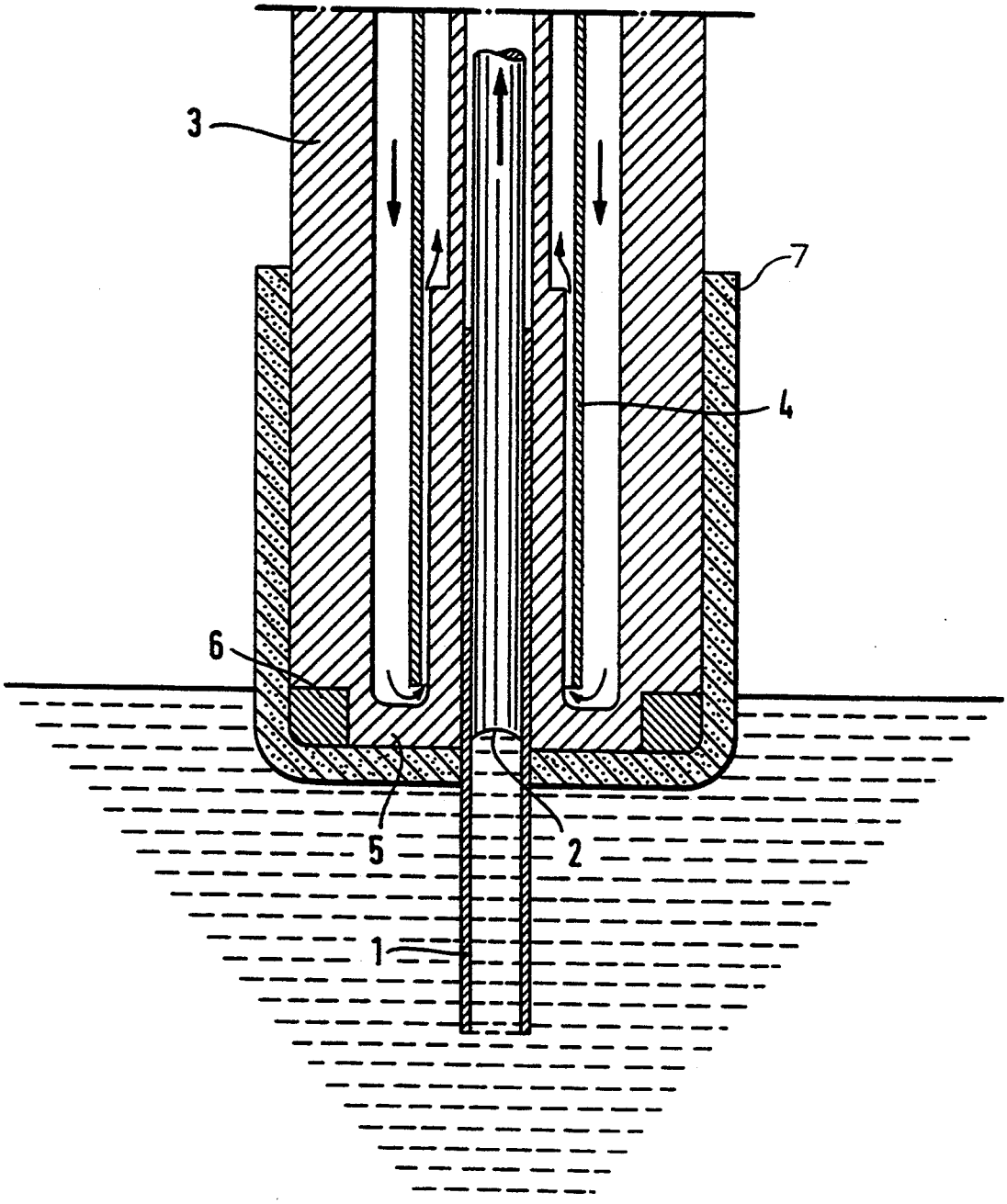
FIG. 2 represents an arrangement according to the present invention, applied to a cooler of continuous upward casting.

FIG. 2 illustrates a state-of-the-art arrangement, which is now provided with the squeeze ring of the present invention. As was pointed out above, the heat content emitted through the nozzle 1 is at its highest at the solidification front 2 and the bottom end 3 of the cooler. It is sometimes difficult to achieve sufficient cooling, and there is created a gap in between the nozzle 1 and the bottom part 5 of the cooler 3, which further weakens heat transfer from the cooler to the piece to be cast. According to the invention, the creation of this gap is prevented by means of the squeeze ring 6 arranged around the outermost part 5 of the cooler. The squeeze ring 6 brings about compression stress in the cooler, and tensile stress in the ring itself. The squeeze ring is attached to the cooler by heating, i.e. as a shrink joint. The squeeze ring is made of a material with a thermal expansion coefficient specifically lower than that of copper. One such material is the iron-nickel alloy sold under the trademark Invar.

As was pointed out above, the invention is not restricted to continuous upward casting, but the squeeze ring pressing the gap in between the cooler and the nozzle can also be used in horizontal casting arrangements.

We claim:

1. An apparatus for continuous casting of a metal object, comprising a nozzle having an inlet part and an outlet part, and a cooler surrounding the outlet part of the nozzle, the cooler having an inner periphery that is in confronting relationship with the nozzle and also having an outer periphery, and the apparatus also comprising a squeeze ring surrounding the cooler and in contact with the outer periphery thereof, the squeeze ring being of a longitudinal extent that is less than that of the cooler and being in a state of circumferential tension, whereby the cooler is pressed against the nozzle, an insulating protective cover is provided to surround the cooler and the squeeze ring.

2. Apparatus according to claim 1, wherein the squeeze ring is fitted to the cooler in the manner of a shrink joint.

3. Apparatus according to claim 1, wherein the cooler comprises a wall means defining a passage for flow of cooling fluid, the wall means comprises an outer peripheral wall that bounds the passage at an outer periphery thereof and an end wall that extends radially with respect to the nozzle, and the squeeze ring surrounds the cooler at the location of said radial wall.

4. Apparatus according to claim 3, wherein the squeeze ring has a longitudinal extent that is substantially equal to that of the radial wall.

5. Apparatus according to claim 1, wherein the squeeze ring is made of a material having a thermal expansion coefficient that is smaller than that of copper.

6. Apparatus according to claim 1, wherein the squeeze ring is made of an alloy of iron and nickel.

7. An apparatus for continuous vertical upward casting of a metal object, comprising a nozzle having an inlet part and an outlet part, and a cooler surrounding the outlet part of the nozzle, the cooler having an inner periphery that is in confronting relationship with the nozzle and also having an outer periphery, and the apparatus also comprising a squeeze ring surrounding the cooler and in contact with the outer periphery thereof, the squeeze ring being in a state of circumferential tension, whereby the cooler is pressed against the nozzle, the squeeze ring being of a longitudinal extent that is less than that of the cooler and being arranged around the nozzle and the bottom part of the cooler, an insulating protective cover is provided to surround the cooler and the squeeze ring.

8. Apparatus according to claim 7, wherein the squeeze ring is fitted to the cooler in the manner of a shrink joint.

9. Apparatus according to claim 7, wherein the cooler comprises a wall means defining a passage for flow of cooling fluid, the wall means comprises an outer peripheral wall that bounds the passage at an outer periphery thereof and an end wall that extends radially with respect to the nozzle, and the squeeze ring surrounds the cooler at the location of said radial wall.

10. Apparatus according to claim 9, wherein the squeeze ring has a longitudinal extent that is substantially equal to that of the radial wall.

11. Apparatus according to claim 7, wherein the squeeze ring is made of a material having a thermal expansion coefficient that is smaller than that of copper.

12. Apparatus according to claim 7, wherein the squeeze ring is made of an alloy of iron and nickel.

* * * * *